US005781830A

United States Patent [19]

Gaylord et al.

[11] Patent Number: 5,781,830

[45] Date of Patent: Jul. 14, 1998

[54] ELECTROLESS PLATED MAGNETIC BRUSH ROLLER FOR XEROGRAPHIC COPIERS, PRINTERS AND THE LIKE

[76] Inventors: Michael F. Gaylord, 10530 W. Jewell #303, Lakewood, Colo. 80235; Sheldon L. Roderick, 10641 W. 102nd Pl., Westminster, Colo. 80021; Randohl A. Roderick, 4420 W. 109th Pl., Westminster, Colo. 80030

[21] Appl. No.: 817,252

[22] PCT Filed: May 23, 1995

[86] PCT No.: PCT/US95/06496

§ 371 Date: Mar. 27, 1997

§ 102(e) Date: Mar. 27, 1997

[87] PCT Pub. No.: WO96/25692

PCT Pub. Date: Aug. 22, 1996

Related U.S. Application Data

[63] Continuation-in-part of Ser. No. 390,524, Feb. 17, 1995, abandoned.

[51] Int. Cl.[6] ..... G03G 15/08

[52] U.S. Cl. ..... 399/109; 399/276

[58] Field of Search ..... 399/109, 267, 399/276; 430/122; 492/8, 18, 54, 58; 29/895.1

[56] References Cited

U.S. PATENT DOCUMENTS

| | | | |
|---|---|---|---|
| 4,517,274 | 5/1985 | Honda et al. | 399/267 X |
| 4,526,130 | 7/1985 | Fukuda et al. | 399/276 |
| 4,876,574 | 10/1989 | Tajima et al. | 399/275 |
| 4,989,044 | 1/1991 | Nishimura et al. | 399/276 X |
| 5,027,745 | 7/1991 | Yamazaki et al. | 399/276 |
| 5,052,335 | 10/1991 | Enoguchi et al. | 399/280 |
| 5,149,914 | 9/1992 | Koga et al. | 399/276 X |
| 5,202,729 | 4/1993 | Miyamoto et al. | 399/103 |
| 5,274,426 | 12/1993 | Goseki et al. | 399/276 |

FOREIGN PATENT DOCUMENTS

| | | |
|---|---|---|
| 2-116857 | 5/1990 | Japan . |
| 4-141685 | 5/1992 | Japan . |
| 6-230676 | 8/1994 | Japan . |

OTHER PUBLICATIONS

JP/58-132768; Patent Abstracts of Japan, Unexamined Applications, Section: P, No. 234, vol. 7, No. 2491, p. 38; Nov. 1983.

The Engineering Properties of Electroless Nickel Deposits, Publication No. 603, pp. 4–11, Nickel Development Institute.

Riedel, Wolfgang, Electroless Nickel Plating, Finishing Publications Ltd., 1991, pp. 104–107, 204–219.

Parker, Konrad, Effects of Heat Treatment on the Properties of Electroless Nickel Deposits, Plating and Surface Finishing, Dec. 1981.

*Primary Examiner*—Nestor R. Ramirez

*Attorney, Agent, or Firm*—F. A. Sirr; E. C. Hancock; Holland & Hart llp

[57] ABSTRACT

A thin film of electroless plated nonmagnetic nickel/phosphor (Ni/P) forms at least the external cylindrical surface of a hollow magnetic brush roller. The plated nonmagnetic film or layer is deposited at least one the exterior cylindrical surface of a hollow, electrically conductive, metal, nonmagnetic, aluminum roller or nonmagnetic stainless steel roller. Alternatively, the plated film is deposited on both the external and internal surfaces of such a development roller that is formed of an electrically conductive and nonmagnetic plastic material. The plated film is electrically conductive and relatively transparent to the magnetic fields that are generated by stationary permanent magnets that are positioned inside of the hollow and rotatable magnetic brush roller. The roller is intended for use in xerographic copiers, printers, and the like. The invention is usable both in the new-build of magnetic brush developers and in the refurbishing/recycling of existing magnetic brush developers apparatus.

58 Claims, 2 Drawing Sheets

ELECTROLESS PLATED MAGNETIC BRUSH ROLLER FOR XEROGRAPHIC COPIERS, PRINTERS AND THE LIKE

This application is a continuation-in-part of U.S. Ser. No. 08/390,524, filed on Feb. 17, 1995 for Electroless Plated Magnetic Brush Roller for Xerographic Copiers, Printers and the Like, now abandoned.

BACKGROUND OF THE INVENTION

1. Field of the Invention

This invention relates to the field of xerography or electrophotography, and to the use of a magnetic brush developer roller to deposit toner on the electrostatic latent image that is carried by a movable member, such as a photoconductor or photoreceptor, that travels on a path adjacent to the rotating development roller(s) of a magnetic brush developer apparatus. More specifically, this invention provides an electroless plated nickel/phosphor (Ni/P) layer on the external and the internal cylindrical surfaces of hollow, electrically conductive metal or electroless plateable plastic, and nonmagnetic magnetic brush roller(s).

2. Description of the Related Art

A wide variety of magnetic brush developer apparatus are known in the xerographic art, including developer apparatus having one or more rotating rollers that carry a single-component toner or a two-component toner to the development nip that is formed by the roller(s), and an electrostatic latent image that is carried by a closely adjacent and moving photoreceptor, such as a belt photoconductor or a drum photoconductor. Both contact toner development and jumping toner development of the latent image are known. It is also known that the photoconductor and development roller may rotate in the same direction within the development nip, or they may rotate in opposite directions within the development nip.

The following United States patents are of general interest relative to magnetic brush developer apparatus. U.S. Pat. No. 4,517,274 relates to a method for developing electrostatic latent images wherein a magnet is contained within a rotating delivering sleeve that carries developing particles thereon. U.S. Pat. No. 4,876,574 describes a developing apparatus having a developing sleeve that is made of aluminum. U.S. Pat. No. 5,052,335 describes a developing device having an endless toner support member that is loosely fitted over the outer periphery of an electrically conductive drive roller. The drive roller is formed of aluminum, stainless steel, or is formed by winding electrically conductive material such as nitrile rubber, silicone rubber, styrene rubber or butadiene rubber around the periphery of a metal roller. The tubular shaped and loosely-fitting member that supports the toner is formed of a soft resinous sheet that is made of polycarbonate, nylon or fluoroplastic, or a sheet of such a resin mixed with carbon, metallic powder, or a thin film that is made of nickel, stainless steel or aluminum, or a laminated sheet of the resinous sheet and the metallic thin film. U.S. Pat. No. 5,149,914 in which a development member is covered by a tubular shaped membrane member, the membrane member being driven by the drive roller through frictional engagement therewith. The membrane member may be formed of natural rubber, silicone rubber, urethane rubber, butadiene rubber, chloroprene rubber or NBR. The use of a membrane member formed of a metal foil such as phosphor bronze, stainless steel or nickel, or formed of a resin membrane material, such as nylon, polyamide or polyethylene terephthalate is suggested. The use of a conductive layer containing a conductive metal such as Al or Ni is suggested.

Other publications of general interest include U.S. Pat. No. 5,027,745 whose development roller has a surface containing carbon fibers, U.S. Pat. No. 5,202,729 whose development roller comprises a metal base having a resin coating in which fine conductive particles are dispersed.

An important utility of the present invention is in the rebuilding or remanufacture of spent toner cartridges or developer apparatus; i.e., the remanufacture or recycling of toner cartridges whose limited supply of toner has been depleted during use of the cartridge in a xerographic reproduction device.

U.S. Pat. Nos. 4,989,044 and 5,274,426, incorporated herein by reference, show such an expendable toner cartridge having a developing sleeve comprising a cylindrical aluminum or stainless steel base member, this base member having an outer surface coating made of resin material in which electrically conductive fine particles, such as fine graphite, are dispersed.

In accordance with a feature of the present invention, this coating of resin material is removed and then replaced by an electroless plated thin nonmagnetic coating of NI/P; for example, in a preferred embodiment Ni/P whose P content renders the coating substantially nonmagnetic.

While the art as exemplified above is generally useful for its limited intended use, the need remains in the art for a development roller having long life, and that provides toner developed images of high quality, such as high image definition and high image contrast. In addition, the need remains in the art for a development roller of a construction and arrangement facilitating refurbishment/recycling of spent magnetic brush developer apparatus; i.e., the refurbishment/recycling of an otherwise spent magnetic brush developer apparatus whose toner supply has been depleted, and wherein the intention is to replace the spent developer apparatus with a replacement developer apparatus that contains a full supply of toner.

SUMMARY OF THE INVENTION

This invention provides a magnetic brush development roller that is usable in the developer apparatus of a wide variety of well-known xerographic devices, examples of which are copier devices, facsimile devices, computer output printer devices, and the like.

The present invention is usable in the new-build or original manufacture of single or multiple roller magnetic brush developer apparatus, and in the new-build or original equipment manufacture of developer rollers that are used in magnetic brush developer apparatus. In addition, the present invention is useful in the refurbishing, recycling, or rebuilding of existing magnetic brush developer apparatus wherein the existing magnetic brush developer apparatus is resupplied with toner, and generally refurbished for reuse in the xerographic device. This utility of the invention relates generally to that field of xerographic devices wherein the original manufacturer designed the developer apparatus with the intent that when the toner within the original developer apparatus was used-up, the entire original developer apparatus would be removed and replaced with a new or refurbished developer apparatus having at least a new supply of toner therein.

In its broadest aspects, the invention provides an electroless plated thin film of the nonmagnetic metal nickel/phosphor (Ni/P) that forms at least the external cylindrical surface of the hollow magnetic brush roller(s) within a magnetic brush developer. The plated layer is preferably deposited on both the internal and the exterior cylindrical surfaces of a hollow, electrically conductive, metal, nonmagnetic, aluminum roller or nonmagnetic stainless steel roller, and can also be deposited on both the internal and external surfaces of an electrically conductive and nonmagnetic and electrically conductive plastic roller that is electroless platable.

Preferred is a Ni/P film whose P content renders the layer electrically conductive and relatively transparent to the magnetic fields that are generated by stationary permanent magnets that are positioned inside of the hollow and rotatable magnetic brush roller.

These and other objects, features and advantages of the invention will be apparent to those of skill in the art upon reference to the following detailed description, which description makes reference to the drawing.

DESCRIPTION OF THE PREFERRED EMBODIMENT

Figure 1:
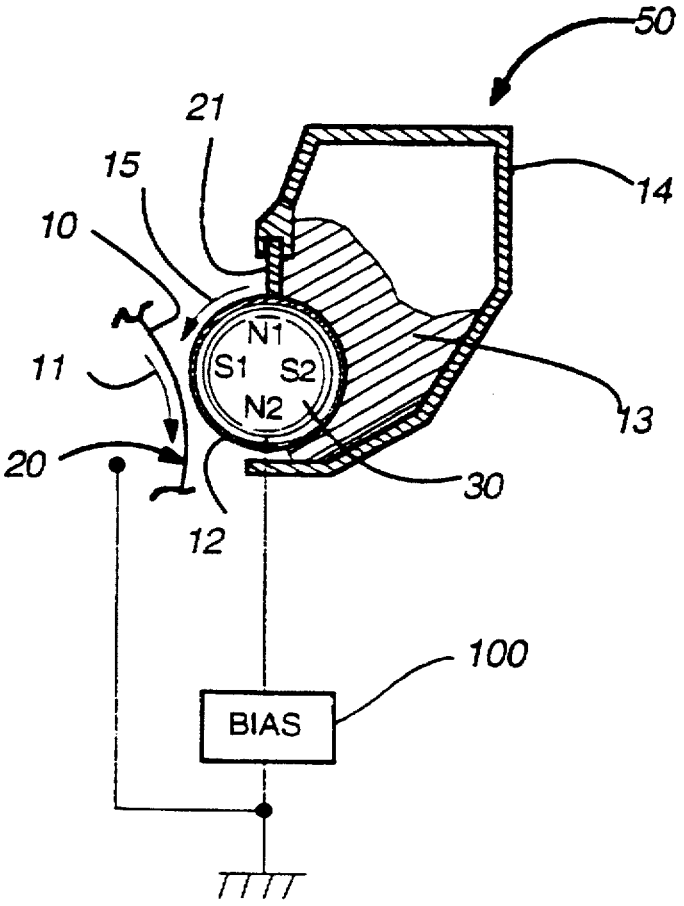
Fig. 1 PRIOR ART
FIG. 1 is a diagrammatic showing of an original equipment, prior art, replaceable toner cartridge or xerographic developing apparatus.

While the present invention is not to be limited thereto, in embodiments of the invention the electroless plated metal nickel-phosphorus was applied to developer rolls, such as 12 of FIG. 1, that were taken from spent toner cartridges taken from Canon, Xerox and Pitney Bowes xerographic printers. In all cases, when the refurbished devices were returned to the original printer, the print quality that was provided by the refurbished devices that now included developer rolls in accordance with the invention was of a higher quality than the print quality that was provided by the original equipment device.

While electroless nickel-phosphorus plating in accordance with the invention is preferred on metal rolls, such as aluminum and stainless steel rolls, the invention finds equal utility when plating dielectric rollers; for example, mineral filled plastics.

In embodiments of the invention, the thickness of the plated layer was in the range of about 0.0001 to about 0.01 inch.

A valuable utility of the invention is in the refurbishing, recycling or rebuilding of well known original equipment toner cartridges that include a supply of toner in a unitary housing with a limited supply of toner; for example, toner cartridges that are contained in xerographic printers supplied by companies such as Canon, Xerox and Pitney Bowes. This recycling utility of the invention will be described in detail with reference to FIG. 2.

While the details of construction of such original equipment toner cartridges, such as 50 of FIG. 1, vary somewhat from one manufacturer to the other, all such toner cartridges 50 include a limited supply of toner and a hollow magnetic brush development roller, the roller being rotationally driven by a gear means.

In one such original equipment magnetic brush developer apparatus, one end of the developer roller is provided with a plug having an axially-extending hole therein. A removable ring gear includes a mating boss that enables the ring gear to be mounted onto this end of the development roller. Stationary magnets within the roller, the moving roller itself, and a stationary toner doctoring blade(s) that are mounted adjacent to the roller, all cooperate in a well-known manner to feed a controlled-thickness layer of toner to a small development nip, space or gap that is formed with a moving photoreceptor or photoconductor that carries a latent electrostatic image thereon. In a well-known manner, toner is selectively deposited only on the latent electrostatic image. In this way, the toner cartridge eventually becomes depleted of its limited toner supply.

Figure 2:
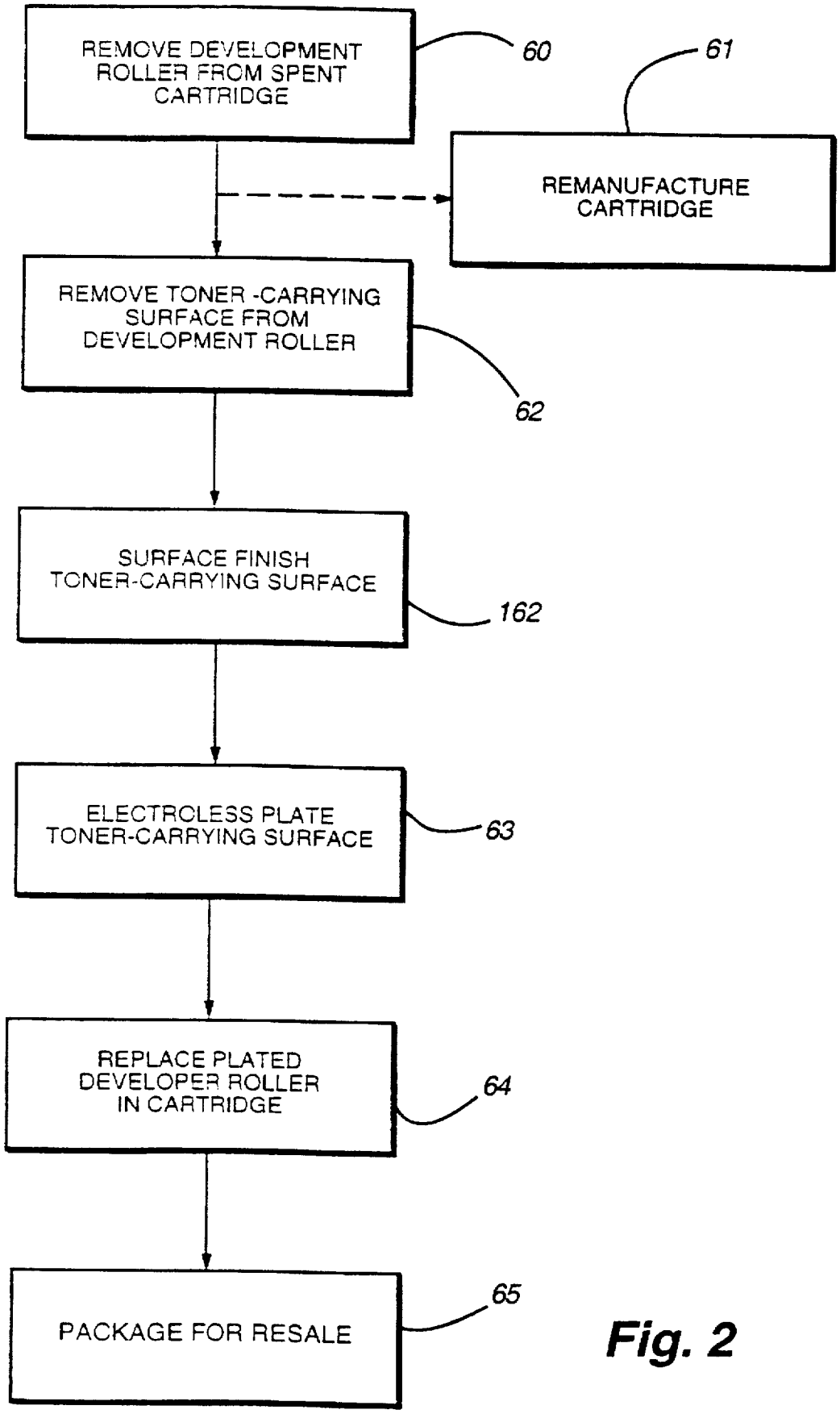
FIG. 2 is a flowchart showing remanufacture or recycling of the developing apparatus of FIG. 1 in accordance with the invention.

While the user may purchase an original equipment toner cartridge 50 of FIG. 1 in order to replace the spent toner cartridge, an industry has originated whereby spent original equipment toner cartridges are refurbished, recycled or rebuilt, and then offered for sale in competition with toner cartridges of the original equipment manufacturer, as is shown and discussed relative to FIG. 2.

When the present invention is to be used in such a FIG. 2 refurbishing industry, the thickness of the plated layer is preferably in the range of about 0.00005 to about 0.001 inch, these dimensions being provided in order to accommodate the thickness of the development nip that is provided by the original equipment manufacturer. An additional advantage that is achieved by the present invention when used to refurbish original equipment toner cartridges is that the nickel-phosphorus electroless plating of the invention is also applied to the above-mentioned, somewhat worn, gear-mounting-plug that is located at one end of the development roller. This coating not only operates to restore the plug's slotted hole to nearly its original manufactured dimensional tolerance, but the coating also provides a wear resistant surface for subsequent operation of the developer roll.

In accordance with a feature of the invention, the preferred phosphorous content of the nickel-phosphorous coating is in the range of about 2% to about 12%, and more preferably in the range of about 10% to about 12%. While nickel-phosphorous coatings in the range of about: 2% to about 12% are operable, it has been found that when the phosphorus content is low, such as from about 2% to about 6%, the coating's magnetism is about 30 oersteads, and such a roller may operate to disturb the magnetic field design that is provided by some, but not all, original equipment manufacturers. Mid-range phosphorus content coatings, such as from about 60 to about 9% phosphorous, are less magnetic (about 1.4 oersteads), and such coatings satisfy the design requirements of more of the original equipment manufacturers. Since high phosphorous content coatings in the range of about 10% to about 12% phosphorus are essentially nonmagnetic (about 0.2 oersteads), they are the preferred coatings of the present invention. In accordance with this invention, the phosphorous content that is operable to render the Nickel-Phosphorous layer essential nonmagnetic is greater than about 7 percent phosphorous.

While the term nickel-phosphorous coatings is used herein, it is to be noted that the use of nickel-phosphorous composition coatings is within the spirit and scope of the invention. Such composition coatings may include the use of small particles of intermetallic compounds, calcium fluoride, fluorocarbons, diamonds and teflon dispersed in a nickel-phosphorous matrix, wherein most of these composites include phosphorous in the high 10% to 12% range. One such high phosphorous content composite coating found to be useful in accordance with the invention included about 25% teflon.

FIG. 1 is a diagrammatic showing of an original equipment, prior art, developing apparatus 50, and more specifically, shows the developing apparatus of above noted U.S. Pat. No. 4,989,044.

In this device 50, which device is typical of devices providing both a recycling and a new-build utility for the present invention, an image bearing photoconductor member 10 having an electrostatic latent image thereon rotates in the direction indicated by arrow 11. A toner carrying cylindrical sleeve or development roller 12 carries a one-component magnetic toner 13 from a hopper 14, as sleeve 12 rotates in the direction 15. Toner 13 transfers from sleeve 12 to photoconductor 10 in a development nip or zone 20. A regulating or doctor blade 21 made of a ferromagnetic metal cooperates with sleeve 12 to regulate the thickness of the layer of toner 13 that is provided to development nip 20. A permanent magnet structure 30 provides a magnetic field for the transport of toner 13 and for the development of the latent image. As stated in U.S. Pat. No. 4,989,044, sleeve 12 is provided with an outer coating that is made of resin material in which electrically conductive fine particles are dispersed.

In accordance with the present invention, during rebuilding of the device of FIG. 1, the above-mentioned coating of resin material is removed by a means that is not critical to the broad aspects of the present invention. Well known examples of such coating removal means include chemical, bead blasting, centerless grinding and vibratory finishing.

A well-known electroless plating process is now used to provide a thin engineering coating of nickel-phosphorus onto at least the cylindrical outer surface of sleeve 12, and more preferably on both the outer and inner cylindrical surfaces of sleeve 12. While the present invention is not to be limited thereto, electroless nickel-phosphorus plating was applied to sleeve 12 in the range of about 0.0001 to about 0.01 inch and more preferably in the range of about 0.00005 to about 0.001 inch.

As is usual with a developer apparatus such as 50, a well-known source of development electrode voltage 100 is provided for hollow sleeve 12. When voltage source 100 makes electrical contact to sleeve 12 by way of sliding contact with the inner surface of sleeve 12, the Ni/P electroless plating of sleeve 12 in accordance with the invention provides a superior internal surface for such sliding electrical contact.

The present invention uses well-known electroless plating processes to provide a thin engineering coating of nickel-phosphorus on developer roll 12 of FIG. 1, the preferred coating being nickel-phosphorus having a defined phosphorus content.

In the well-known electroless nickel plating process, hot acid hypophosphite reducing baths are most frequently used to plate steel and other metals, whereas warm alkaline hypophosphite baths are used for plating plastics and nonmetals. It is known that hypophosphite reduced electroless nickel (sometimes called metallic glasses) is an unusual engineering material whose coatings are uniform, hard, relatively brittle, lubricous, and highly corrosion resistant.

Use of electroless nickel plating in a number of technical fields is known, including its use in printing rolls, press beds, and material handling gears and clutches. The use of electroless nickel for buildup of worn or over-machined surfaces is also known.

In accordance with the present invention, the above properties provide a new and unusual coating for a magnetic brush developer roller, such as 12 of FIG. 1, either when originally manufacturing such a roller 12, or when refurbishing such a roller 12 during the process of remanufacturing/recycling a spent toner cartridge such as 50 of FIG. 1.

Published specifications for electroless nickel-phosphorus include (1) AMS 2404B, Electroless Nickel Plating, *Society of Automotive Engineers*, 1977, (2) *ASTM Standard B*656, Autocatalytic Nickel Deposition on Metals for Engineering Use, *American Society for Testing and Materials*, Part 9, 1981, and (3) MIL-C26074B, Military Specification-Coatings, Electroless Nickel, Requirements for, U.S. Government Printing Office, 1959 and 1971.

While an important utility of the present invention is in the original manufacture of a developer apparatus 50 of the general type shown in FIG. 1, FIG. 2 is a flowchart showing of the remanufacture, recycling or refurbishing of developer apparatus 50 of FIG. 1 in accordance with a feature of the invention.

In step 60 of this process, developer roll or roller 12 is first removed from a spent cartridge, such as 50 of FIG. 1. While not a critical step in the process of the invention, a step 61 is usually provided to perform other remanufacturing steps on cartridge 50, such as for example replacement of a supply of toner 13 within hopper 14 and replacement of blade 21.

In accordance with the invention, at step 62 of the process the original manufacturer's toner-carrying surface coating (for example, the resin material of above-mentioned U.S. Pat. Nos. 4,989,004 and 5,274,426) is now removed from the major longitudinal center and external surface of developer roller 12. While the means that is used in removal step 62 is not critical to the broad aspects of the present invention, methods such as chemical removal, centerless grinding, bead blasting and vibration finishing are suggested.

In step 162 of the process, the toner-carrying portion of the developer roller is surface-finished in preparation for plating step 63. In step 162, the external toner-carrying surface of a developer roller, such as 12, comprises the major central portion of the roller's external surface, and usually excludes the short opposite end external portions of the roller.

While smooth machine finishing is acceptable in step 162, in an embodiment of the invention bead blasting with hard beads; for example, metal beads, of a sieve rating from about 100 to about 300 was used.

The surface finishing that is accomplished in step 162 may be provided by a number of well known finishing means, including centerless grinding, centerless sanding, bead blasting, and vibratory tub mass finishing. Whatever means is selected, step 162 provides a surface roughness, as measured by a profilometer, reading about 10 to about 120 micro inches (or its equivalent in micro meters), with a surface roughness of about 50 micro inches (or its equivalent in micro meters) being preferred.

Step 162 may also include polishing the two above-mentioned external and opposite ends of roller 12 that do not partake in the xerographic process, as by the use of a fine ScotchBrite buffing wheel. These two end portions cooperate, for example, with wool felt toner seals (not shown) that are mounted within developer apparatus 50 of FIG. 1.

Of course, step 162 may include other steps preparing roller 12 for electroless plating step 63, as is desired.

At step 63 of the process, developer roller 12 is plated with a controlled and critical thickness of nickel-phosphorus, preferably wherein the phosphorus-percent of the Ni/P layer is controlled as abovementioned.

As will be appreciated, when a hollow metal roller such as an aluminum or stainless steel roller, or when a hollow plastic roller is electroless plated in step 63, both the inner and the outer surfaces of the roller receive a thin plating layer. The roller's outer plated layer has a surface texture that is established by the surface texture that results from operation of step 162, and preferably the surface texture of the plated layer is that provided by using bead blasting with beads of a sieve rating of from about 100 to about 300.

In some known xerographic devices, sliding electrical contact is made to the development roller by way of contact with the roller's inner surface. In these devices, the nonoxidizable inner plated Ni/P layer provides excellent electrical contact characteristics.

At step 64 of the process, the electroless plated roller 12 is remounted in the remanufactured developer cartridge that is produced by step 61, and then at step 65 the completely refurbished and recycled developer apparatus 50 of FIG. 1 is packaged for resale.

In an embodiment of the invention, both surface removing step 62 and surface finishing step 162 of FIG. 2 were carried out using a vibratory finishing machine of a conventional and well known construction, this process sometimes being called vibratory tub mass finishing. Such a finishing machine is well known for its use in deburring metal parts and/or in rubbing and thereby smoothing the metal parts.

Generally, such a finishing machine consists of a metal, urethane lined, open top, rectangular tub that is somewhat filled with a vibratory media. The tub is spring mounted, and is vibrated by a rotating motor that is mounted generally in the center of the finishing machine, immediately below the tub. As the tub vibrates, the vibratory media that is contained therein rolls and beats against the development rollers that are produced by step 60 and that are also contained within the tub. As is well known, one function of the vibratory media is to keep the development rollers physically separated so that they do not impact each other during this process.

It is desirable that the tub include a well known, soap-like, liquid cleaning solution that is dispersed throughout the vibratory media. This cleaning solution operates to carry away the toner-carrying surface material that is rubbed off of the development rollers, as the vibratory finishing machine accomplishes the function of step 62.

The physical shape of the vibratory media that is within the tub can take a variety of forms, and without limitation thereto may include cylinders, stars, pyramids, wedges, spheres, squares, and cones. While it is desirable that the two opposite and circular ends of the development rollers be physically closed, as by the use of tape, a plug, or the like, as a feature of the invention the size of the selected vibratory media shape is such that the vibratory media is too large to enter within the hollow cylindrical development rollers. The material from which the vibratory media is made is usually selected from the group plastic, ceramic, and aluminum oxide.

As an example, the vibratory finishing machine is operated from about 30 minutes to about 45 minutes in order to perform the function of step 62. During this time period the development roller's toner-carrying surface is removed from the central external surface of the development roller, and the two end external and cylindrical surfaces of the development rollers (i.e. the two ends of the development rollers that cooperate with developer apparatus bushings, seals and the like) are smoothed.

After the toner-carrying surface has been removed from the development rollers, the development rollers are removed from the tub and the two opposite, external, and cylindrical ends of the development rollers are covered or masked to protect this smooth surface from the surface finishing that next is to be accomplished in step 162. The development rollers are then returned to the tub, and an additional, small size, grit media is added to the tub. During subsequent operation of the vibratory finishing machine this grit media coats the exterior surface of the larger size vibratory media. In subsequent operation of the vibratory finishing machine, the coated vibratory media operates to perform the surface finishing function of step 162. In general, the function of step 162 is accomplished by operating the vibratory finish machine for about 20 to about 45 minutes.

Within the broad spirit and scope of the invention the size, shape and composition of the vibratory media can vary greatly. The major consideration is that the vibratory media should be of a size so as not to enter the ends of the development rollers, and the vibratory media should be of a size so as not to dent or pit the surface of the development rollers.

The size of the grit media can vary generally within the range of from about 50 grit to 300 grit, and the grip material type can include the group silicon carbide, aluminum oxide, turkish emery, glass beads, and steel shot. In the later case of using steel shot, the use of a rust inhibitor is suggested.

In an embodiment of the invention, the vibratory media comprised solid ceramic cylinders of a size about ⅜ inch in diameter and about ⅝ inch long, wherein the two circular ends or edges of the cylinders were formed to a taper of about 45 degrees. In this embodiment of the invention, the grit media was of a size about 100 grit in the shape of slivers, and the grit media was formed of silicon carbide.

The invention has been described while making detailed reference to preferred embodiments thereof. However, since it is appreciated that those skilled in the art will readily visualize yet other embodiments that are within the spirit and scope of the invention, above-detailed description is not to be taken as a limitation on the spirit and scope of the invention.

I claim:

1. In xerographic developer apparatus having a supply of toner and a hollow and rotatable development roller having magnetic field generating means therein, said development roller having an outer surface operating to carry a quantity of said toner supply to a moving electrostatic latent image that passes adjacent to said development roller, the improvement comprising;

said outer surface of said development roller having an electroless Nickel-Phosphorus layer thereon, said Nickel-Phosphorus layer having a Phosphorus content so as to render said Nickel-Phosphorus layer essentially nonmagnetic.

2. The developer apparatus of claim 1 wherein said development roller comprises a circular-cylinder base member selected from the group aluminum, stainless steel and electrically conductive plastic, and wherein said electroless Nickel-Phosphorus layer comprises an external layer on said base member.

3. The developer apparatus of claim 2 wherein said Nickel-Phosphorus layer is in the range of about 0.0001 to about 0.001 inch thick.

4. The developer apparatus of claim 2 wherein said Nickel-Phosphorus layer is in the range of about 0.00005 to about 0.001 inch thick.

5. The developer apparatus of claim 2 wherein said Phosphorus content is in the range of about 2 percent to about 12 percent.

6. The developer apparatus of claim 2 wherein said. Phosphorus content is in the range of about 10 percent to about 12 percent.

7. The developer apparatus of claim 6 wherein said Nickel-Phosphorus layer is in the range of about 0.0001 to about 0.001 inch thick.

8. The developer apparatus of claim 6 wherein said Nickel-Phosphorus layer is in the range of about 0.00005 to about 0.001 inch thick.

9. The developer apparatus of claim 1 wherein said development roller comprises a hollow cylindrical base member selected from the group aluminum, stainless steel and electrically conductive plastic, wherein said electroless Nickel-Phosphorus layer comprises an external layer and an internal layer on said hollow base member, and wherein a development electrode bias voltage is applied to said development roller by way of sliding electrical contact to said inner layer.

10. The developer apparatus of claim 9 wherein said Phosphorus content is in the range of from about 2 percent to about 12 percent.

11. The developer apparatus of claim 9 wherein said Nickel-Phosphorus layer is in the range of about 0.0001 to about 0.001 inch thick.

12. The developer apparatus of claim 9 wherein said Nickel-Phosphorus layer is in the range of about 0.00005 to about 0.001 inch thick.

13. The developer apparatus of claim 12 wherein said Phosphous content is in the range of from about 10 percent to about 12 percent.

14. A method for rebuilding a xerographic developer apparatus that has a limited supply of toner, a hollow and rotatable development roller, and magnetic field generating means within said roller, said development roller having an outer surface that operates to carry a quantity of said limited toner supply to a moving electrostatic latent image that passes adjacent to said development roller, the rebuilding method comprising the steps of;

removing said development roller from a developer apparatus whose supply of toner has become depleted, surface finishing said outer surface of said development roller, electroless plating said surface finished outer surface of said development roller with a Nickel-Phosphorus layer, said Nickel-Phosphorus layer having a Phosphorus content so as to render said Nickel-Phosphorus layer essentially nonmagnetic, replacing said plated development roller in said developer apparatus, and replenishing said developer apparatus with a said limited supply of toner.

15. The method of claim 14 wherein said development roller comprises a circular-cylinder member selected from the group aluminum, stainless steel and electrically conductive plastic, and wherein said electroless Nickel-Phosphorus layer comprises an external layer on said member.

16. The method of claim 15 wherein said Nickel-Phosphorus layer is in the range of about 0.0001 to about 0.001 inch thick.

17. The method of claim 15 wherein said Nickel-Phosphorus layer is in the range of about 0.00005 to about 0.001 inch thick.

18. The method of claim 15 wherein said Phosphorus content is in the range of about 2 percent to about 12 percent.

19. The method of claim 15 wherein said Phosphorus content is in the range of about 10 percent to about 12 percent.

20. The method of claim 14 wherein said surface finishing step comprises bead blasting said outer surface of said development roller with metal beads having a sieve rating of from about 100 to about 300.

21. The method of claim 20 wherein said Nickel-Phosphorus layer is in the range of about 0.0001 to about 0.001 inch thick.

22. The method of claim 20 wherein said Nickel-Phosphorus layer is in the range of about 0.00005 to about 0.001 inch thick.

23. The method of claim 22 wherein said development roller comprises a hollow cylindrical member selected from the group aluminum, stainless steel and electrically conductive plastic, wherein said electroless Nickel-Phosphorus layer comprises an external layer and an internal layer on said hollow base member, and wherein a development electrode bias voltage is applied to said development roller by way of sliding electrical contact to said inner layer.

24. The method of claim 23 wherein said Phosphorus content is in the range of from about 2 percent to about 12 percent.

25. The method of claim 14 wherein said step of surface finishing said outer surface of said development roller is performed by surface finishing apparatus selected from the group centerless grinding, centerless sanding, bead blasting and vibratory tub mass finishing.

26. The method of claim 25 wherein said step of surface finishing said outer surface of said development roller produces a surface roughness within the range about 10 micro inches to about 120 micro inches.

27. The method of claim 26 wherein said step of surface finishing said outer surface of said development roller produces a surface roughness of about 50 micro inches.

28. A method for manufacturing a hollow, cylindrical, xerographic development roller that is adapted to have magnetic field generating means placed within said roller, said roller having an outer surface that operates to carry xerographic toner to a moving electrostatic latent image that passes adjacent to said roller, the method comprising the steps of;

using a finishing machine to surface finishing said outer surface of said roller to a surface roughness in the range of about 10 micro inches to about 120 micro inches, and electroless plating said surface finished outer surface of said roller with a Nickel-Phosphorus layer, said Nickel-Phosphorus layer having a Phosphorus content so as to render said Nickel-Phosphorus layer essentially nonmagnetic.

29. The method of claim 28 wherein said roller comprises a circular-cylinder member that is selected from the group aluminum, stainless steel and electrically conductive plastic, and wherein said electroless Nickel-Phosphorus layer comprises an external layer on said member.

30. The method of claim 29 wherein said Nickel-Phosphorus layer is in the range of about 0.0001 to about 0.001 inch thick.

31. The method of claim 29 wherein said Nickel-Phosphorus layer is in the range of about 0.00005 to about 0.001 inch thick.

32. The method of claim 29 wherein said Phosphorus content is in the range of about 2 percent to about 12 percent.

33. The method of claim 29 wherein said Phosphorus content is in the range of about 10 percent to about 12 percent.

34. The method of claim 28 wherein said surface finishing step comprises vibratory finishing said outer surface of said development roller with vibratory media that is coated with grit media having a size ranging from about 50 grit to about 300 grit.

35. The method of claim 34 wherein said Nickel-Phosphorus layer is in the range of about 0.0001 to about 0.001 inch thick.

36. The method of claim 34 wherein said Nickel-Phosphorus layer is in the range of about 0.00005 to about 0.001 inch thick.

37. In a xerographic developer roller having an outer surface operable to carry a quantity of toner to a moving electrostatic latent image that passes adjacent to said developer roller, the improvement comprising;

said outer surface of said developer roller having an electroless Nickel-Phosphorus layer thereon, said Nickel-Phosphorus layer having a Phosphorus content so as to render said Nickel-Phosphorus layer essentially nonmagnetic.

38. The development roller of claim 37 wherein said developer roller comprises a circular-cylinder base member selected from the group aluminum, stainless steel and electrically conductive plastic, and wherein said electroless Nickel-Phosphorus layer comprises an external layer on said base member.

39. The developer roller claim 38 wherein said Nickel-Phosphorus layer is in the range of about 0.0001 to about 0.001 inch thick.

40. The developer roller of claim 38 wherein said Nickel-Phosphorus layer is in the range of about 0.00005 to about 0.001 inch thick.

41. The developer roller of claim 37 wherein said Phosphorus content is in the range of about 2 percent to about 12 percent.

42. The developer roller of claim 37 wherein said Phosphorus content is in the range of about 10 percent to about 12 percent.

43. A method for refurbishing a plurality of hollow and cylindrical xerographic development rollers, each of said development rollers being of a given diameter, each of said development rollers including a toner-carrying surface on a major-length central exterior surface thereof, and each of said development rollers having two generally smooth exterior and cylindrical end surfaces, said method comprising the steps of;

placing said plurality of said development rollers in a vibratory finishing machine, placing a quantity of vibratory media in said vibratory finishing machine, said vibratory media being of a size greater than said given diameter of said development rollers, using said vibratory finishing machine to remove said toner-carrying surface from each of said plurality of development rollers, and to smooth said two exterior end surfaces of said development rollers, removing said plurality of development rollers from said vibratory finishing machine, covering said two exterior end surfaces of each of said plurality of development rollers, adding a quantity of grit media of a size about 50 grit to about 300 grit to said vibratory finishing machine so as to coat said vibratory media with said grit media, replacing said plurality of development rollers in said vibratory finishing machine, using said vibratory finishing machine to surface finish said major-length central exterior surface of each of said plurality of development rollers, removing said plurality of development rollers from said vibratory finishing machine, and electroless plating each of said plurality of development rollers with a Nickel-Phosphorus layer having a Phosphorus content so as to render said Nickel-Phosphorous layer essentially nonmagnetic.

44. The method of claim 43 including the step of;

placing a quantity of a cleaning solution in said vibratory finishing machine.

45. The method of claim 43 wherein said vibratory media is selected from the shape group cylinders, stars, pyramids, wedges, spheres, squares, and cones.

46. The method of claim 45 wherein said vibratory media is made from the material group plastic, ceramic, and aluminum oxide.

47. The method of claim 43 wherein said vibratory media is of a size so as prevent denting or pitting said plurality of development rollers.

48. The method of claim 47 wherein said grit media is of a size about 100 grit.

49. The method of claim 48 wherein said grit media is selected from the material group silicon carbide, aluminum oxide, turkish emery, glass beads, and steel shot.

50. The method of claim 43 wherein said vibratory media comprised ceramic cylinders of a size about ⅛ inch in diameter and about ⅝ inch long, and wherein said grit media comprises sliver shape silicon carbide of a size about 100 grit.

51. A method for manufacturing hollow and cylindrical xerographic development rollers, said development rollers being of a given diameter, and said development rollers having a critical-roughness, toner-carrying, surface on an exterior surface thereof, said method comprising the steps of;

placing a quantity of a vibratory media in a vibratory finishing machine, placing a quantity of a grit media of a size about 50 grit to about 300 grit in said vibratory finishing machine, placing a plurality of said development rollers in said vibratory finishing machine, using said vibratory finishing machine to surface finish said exterior surface of said development rollers to a surface roughness in the range of about 10 to about;

removing said development rollers from said vibratory finishing machine, and electroless plating each of said plurality of development rollers with a Nickel-Phosphorus layer having a Phosphorus content so as to render said Nickel-Phosphorous layer essentially nonmagnetic.

52. The method of claim 51 wherein said vibratory media is selected from the shape group cylinders, stars, pyramids, wedges, spheres, squares, and cones, and wherein said vibratory media is made from the material group plastic, emery, and aluminum oxide.

53. The method of claim 52 wherein said grit media is of a size about 100 grit, and wherein said grit media is selected from the material group silicon carbide, aluminum oxide, turkish emery, glass beads, and steel shot.

54. The method of claim 51 wherein said vibratory media comprised solid ceramic cylinders of a size about ⅛ inch in diameter and about ⅝ inch long, and wherein said grit media comprises sliver shaped silicon carbide of a size about 100 grit.

55. The method of claim 54 including the step of;

placing a quantity of a cleaning solution in said vibratory finishing machine.

56. In the Xerographic developer apparatus improvement of claim 1, said Phosphorous content rendering said Nickel-Phosphorous, layer essential nonmagnetic being greater than about 7 percent Phosphorous.

57. The method of claim 28 wherein said Phosphorous content rendering said Nickel-Phosphorous layer essential non-magnetic is greater than about 7 percent Phosphorous.

58. The developer roller of claim 37 wherein said Phosphorous content rendering said Nickel-Phosphorous layer essential nonmagnetic is greater than about 7 percent Phosphorous.

* * * * *